US008794815B2

(12) United States Patent
Hsien

(10) Patent No.: US 8,794,815 B2
(45) Date of Patent: Aug. 5, 2014

(54) MODULAR LIGHTING DEVICE

(71) Applicant: Habitex Corporation, Taipei (TW)

(72) Inventor: Pei Lin Hsien, Taipei (TW)

(73) Assignee: Habitex Corporation, Taipei (TW)

( * ) Notice: Subject to any disclaimer, the term of this patent is extended or adjusted under 35 U.S.C. 154(b) by 0 days.

(21) Appl. No.: 13/738,281

(22) Filed: Jan. 10, 2013

(65) Prior Publication Data

US 2014/0192536 A1 Jul. 10, 2014

(51) Int. Cl.

| | |
|---|---|
| ***H01R 33/00*** | (2006.01) |
| ***F21V 17/06*** | (2006.01) |
| ***F21V 29/00*** | (2006.01) |
| ***F21V 1/00*** | (2006.01) |

(52) U.S. Cl.

CPC ..... *F21V 17/06* (2013.01); *F21V 29/002* (2013.01); *F21V 1/00* (2013.01)

USPC ..... 362/649; 362/186; 362/650; 362/414

(58) Field of Classification Search

USPC ..... 362/294, 640, 410, 414, 441, 448, 443, 362/84, 154, 186, 190, 191, 194, 311.01, 362/311.02, 311.04, 312, 363, 648, 649, 362/650, 413; 313/51

See application file for complete search history.

(56) References Cited

U.S. PATENT DOCUMENTS

| | | | | | |
|---|---|---|---|---|---|
| 1,947,022 | A * | 2/1934 | Schneider | ..... | 362/186 |
| 3,225,186 | A * | 12/1965 | Duncan | ..... | 362/183 |
| 3,274,382 | A * | 9/1966 | Fattori | ..... | 362/186 |
| 3,949,212 | A * | 4/1976 | Larrimore | ..... | 362/263 |
| 4,683,523 | A * | 7/1987 | Olsson et al. | ..... | 362/477 |
| 5,091,834 | A * | 2/1992 | Kao et al. | ..... | 362/648 |
| 5,436,526 | A * | 7/1995 | Hohaus et al. | ..... | 313/51 |
| 5,695,279 | A * | 12/1997 | Sonnleitner et al. | ..... | 362/419 |
| 5,806,965 | A * | 9/1998 | Deese | ..... | 362/249.04 |
| 6,523,970 | B1 * | 2/2003 | Scales, III | ..... | 362/145 |
| 6,616,298 | B1 * | 9/2003 | Bernhard | ..... | 362/650 |
| 7,108,391 | B2 * | 9/2006 | Chuang | ..... | 362/122 |
| 7,329,023 | B2 * | 2/2008 | Mast | ..... | 362/147 |
| 7,534,009 | B2 * | 5/2009 | Trojanowski et al. | ..... | 362/234 |
| 7,985,004 | B1 * | 7/2011 | Schach et al. | ..... | 362/276 |
| 8,292,475 | B2 * | 10/2012 | D'Alelio | ..... | 362/351 |
| 2003/0137830 | A1 * | 7/2003 | Chang | ..... | 362/121 |
| 2006/0146527 | A1 * | 7/2006 | VanderSchuit | ..... | 362/228 |
| 2006/0279954 | A1 * | 12/2006 | Sherman | ..... | 362/353 |
| 2007/0230197 | A1 * | 10/2007 | Scannell | ..... | 362/418 |
| 2008/0144311 | A1 * | 6/2008 | Van Der Poel | ..... | 362/231 |
| 2009/0045715 | A1 * | 2/2009 | Shantha et al. | ..... | 313/51 |
| 2010/0002451 | A1 * | 1/2010 | Reynolds | ..... | 362/363 |

(Continued)

*Primary Examiner* — Nimeshkumar Patel
*Assistant Examiner* — Glenn Zimmerman
(74) *Attorney, Agent, or Firm* — John A. Fortkort; Fortkort & Houston P.C.

(57) ABSTRACT

A modular lighting device includes a base and a lamp head unit. The base includes a base body and a first connecting module disposed at a top end of the base body and having a first connecting portion and a first conductive portion. The lamp head unit includes a bottom seat, a lamp body disposed on the bottom seat, and a lamp shell connected to the bottom seat. The bottom seat includes a second connecting module disposed at a bottom end thereof and having a second connecting portion connected removably to the first connecting portion, and a second conductive portion electrically connected to the first conductive portion. The lamp shell has a maximum width disposed at a position adjacent to a bottom end thereof and smaller than or equal to that of the bottom seat.

6 Claims, 7 Drawing Sheets

(56) References Cited

U.S. PATENT DOCUMENTS

2011/0075404 A1* 3/2011 Allen et al. ..... 362/183
2012/0098402 A1* 4/2012 Fu ..... 313/46
2012/0239521 A1* 9/2012 Acworth et al. ..... 705/26.5

* cited by examiner

MODULAR LIGHTING DEVICE

BACKGROUND OF THE INVENTION

1. Field of the Invention

This invention relates to a lighting device, and more particularly to a modular lighting device.

2. Description of the Related Art

A conventional lighting device typically includes a base, a lamp head disposed on the base, and a lampshade disposed on a junction between the base and the lamp head. The base is connected to a stationary power supply for transmitting electrical energy to the lamp head to provide a lighting function. The lampshade can enable light emitted from the lamp head unit and transmitted therethrough to become more gentle to provide an ornamental effect.

However, in the conventional lighting device, since an end of the lamp head distal from the base is wider than an end of the lamp head proximate to the base, to replace the lampshade, it is necessary to separate the lamp head from the base prior to removal of the lampshade, so that the lampshade is inconvenient and time-consuming to replace.

Furthermore, in the conventional lighting device, the base is electrically connected to the lamp head in a manner that the shape and height of the lighting device cannot be changed. Further, the lighting device is electrically connected to a specific type of power source so that, when moved to a place without such a power source, it cannot be used, thereby resulting in a limited applicable range of the lighting device.

SUMMARY OF THE INVENTION

An object of this invention is to provide a modular lighting device that is capable of being mounted selectively with a lampshade, which can be replaced conveniently.

Another object of this invention is to provide a modular lighting device that is capable of being mounted selectively with a supporting unit to change the shape and height of the lighting device.

Still another object of this invention is to provide a modular lighting device with a portable power source so that the lighting device can be used anywhere.

According to this invention, a modular lighting device includes a base and a lamp head unit. The base includes a base body and a first connecting module disposed at a top end of the base body and having a first connecting portion and a first conductive portion. The lamp head unit includes a bottom seat, a lamp body disposed on the bottom seat, and a lamp shell connected to the bottom seat. The bottom seat includes a second connecting module disposed at a bottom end thereof and having a second connecting portion connected removably to the first connecting portion, and a second conductive portion electrically connected to the first conductive portion. The lamp shell has a maximum width disposed at a position adjacent to a bottom end thereof and smaller than or equal to that of the bottom seat.

Preferably, the lighting device further includes a supporting unit that connects the lamp head unit removably to the base.

Preferably, the base further includes a portable power supply disposed removably within the base body, and a charging connector disposed on the base body and electrically connected to the portable power supply.

Since the maximum width of the lamp shell is disposed at a position adjacent to the bottom end of the lamp shell, and is smaller than or equal to that of the base, it is not necessary to remove the lamp head unit or the lamp shell from the base prior to removal of the lampshade. Furthermore, the base can be connected removably to the lamp head unit or the supporting unit, so as to allow for a change in the shape and height of the lighting device. Further, due to the portable power source is disposed in the base, the lighting device can be used anywhere. As a consequence, the lighting device is convenient to use.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
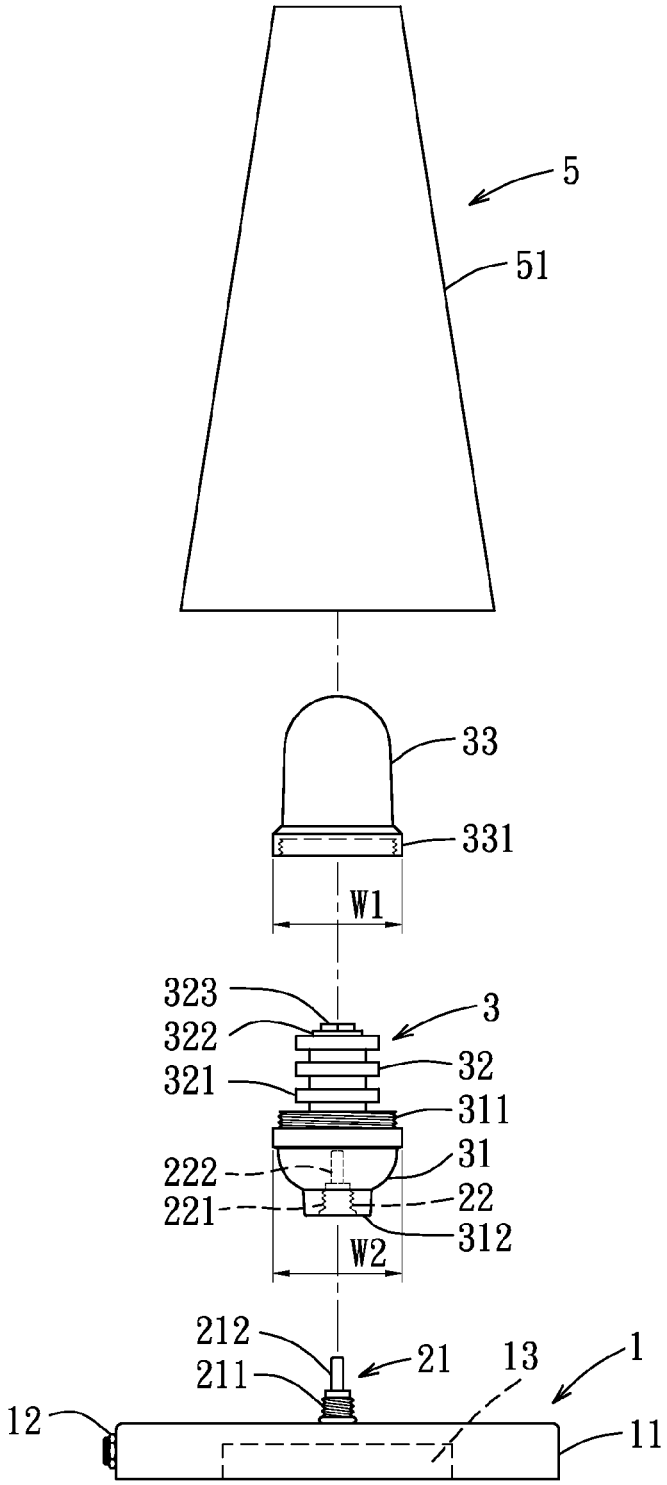
FIG. 1 is an exploded side view of the first preferred embodiment of a modular lighting device according to this invention.

Before the present invention is described in greater detail in connection with the preferred embodiments, it should be noted that similar elements and structures are designated by like reference numerals throughout the entire disclosure.

Figure 2:
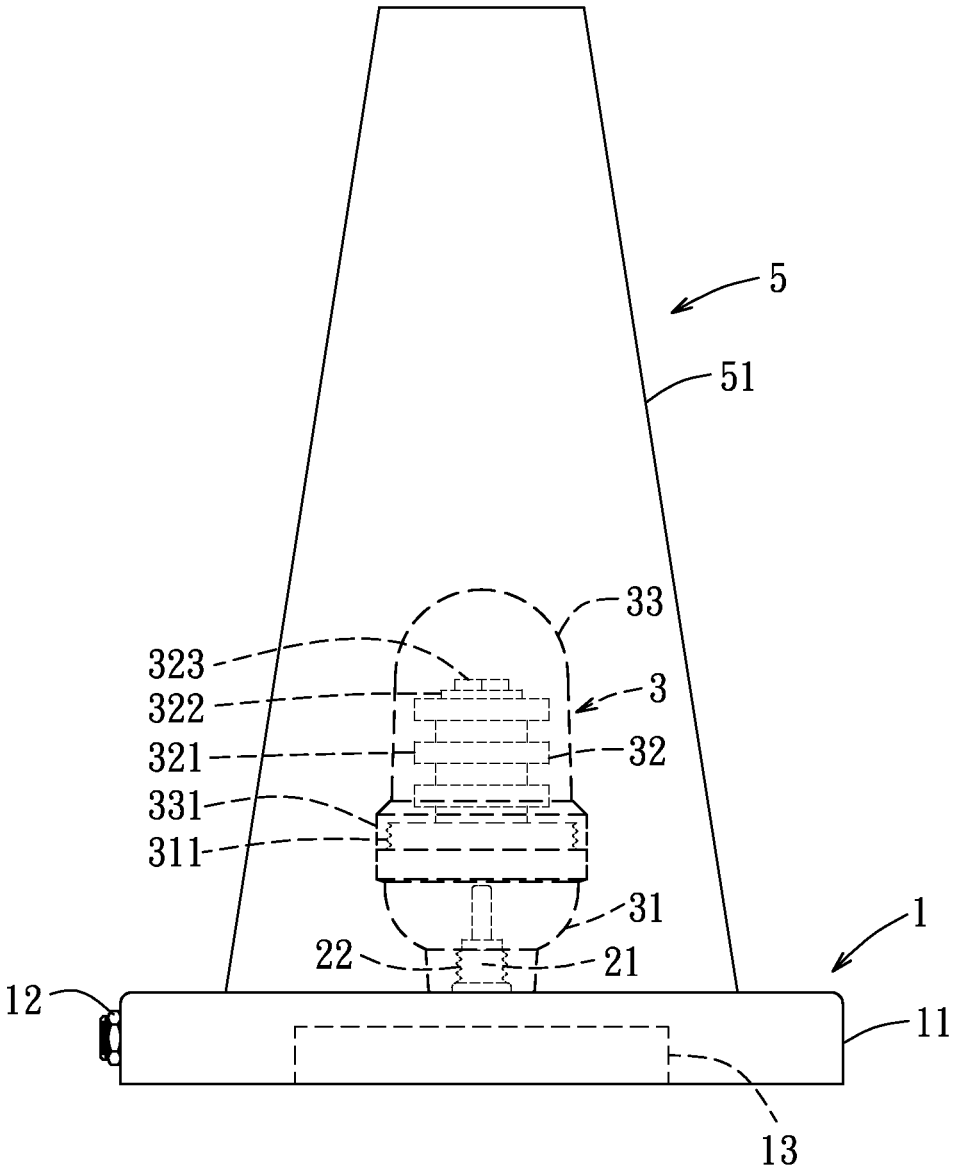
FIG. 2 is an assembled side view of the first preferred embodiment.
Figure 3:
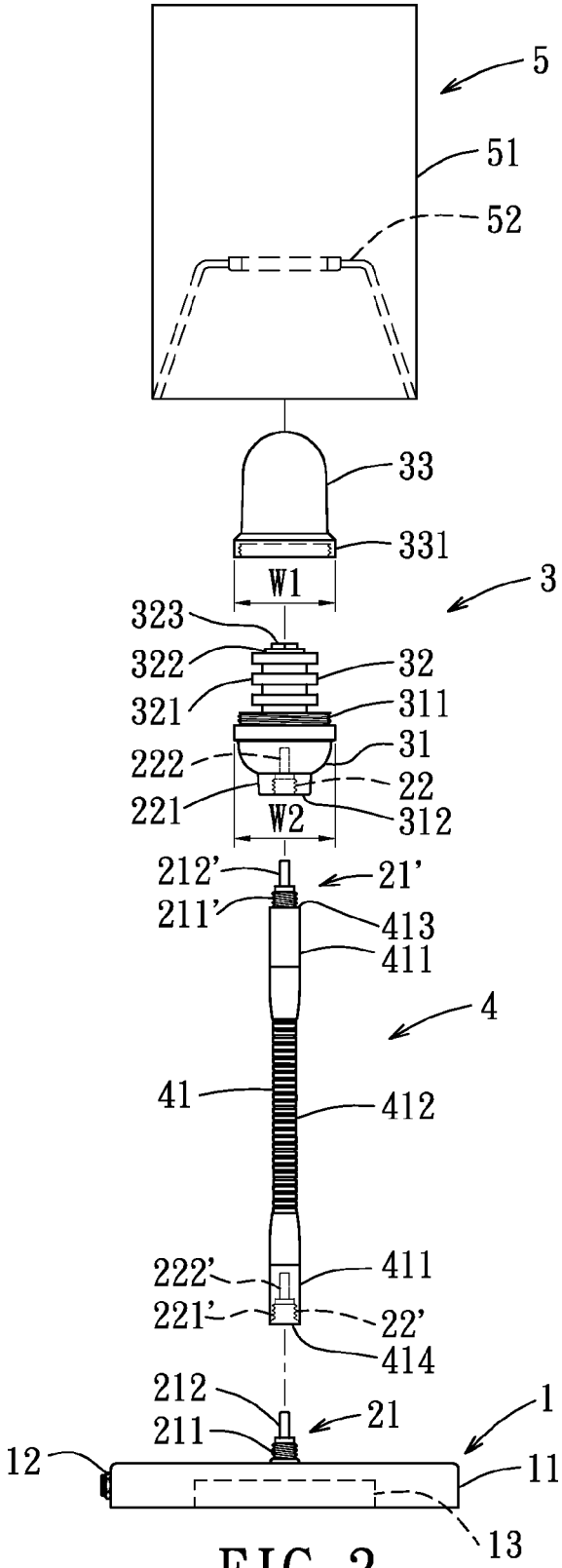
FIG. 3 is an exploded side view of the first preferred embodiment, illustrating that the lighting device includes a removable supporting unit and a replaceable lampshade.
Figure 4:
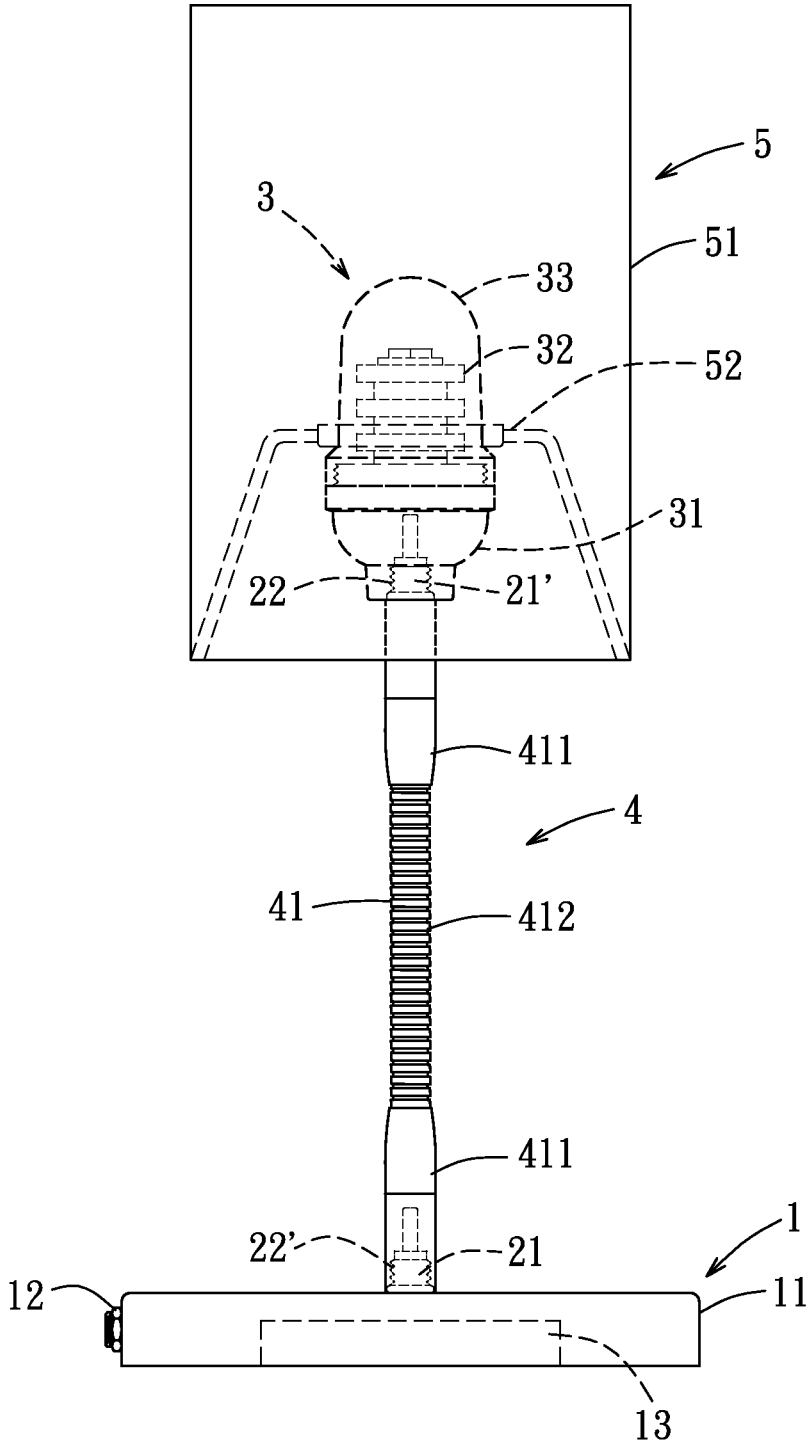
FIG. 4 is an assembled side view of the lighting device of FIG. 3.

Referring to FIGS. 1 to 4, the first preferred embodiment of a lighting device according to this invention includes a base 1, a lamp head unit 3, a supporting unit 4, and a lampshade 5. In this embodiment, the lamp head unit 3 may be disposed removably on the base 1 in a first manner or in a second manner. With particular reference to FIGS. 1 and 2, in the first manner, the lamp head unit 3 is disposed directly on the base 1, such that the supporting unit 4 is removed from the remaining portion of the lighting device. With particular reference to FIGS. 3 and 4, in the second manner, the lamp head unit 3 is disposed indirectly on the base 1, such that the supporting unit 4 is connected between the lamp head unit 3 and the base 1, so that the shape and height of the lighting device are different from those of the lighting device shown FIGS. 1 and 2. The lampshade 5 may be cylindrical, as shown in FIGS. 1 and 2, or frustoconical, as shown in FIGS. 3 and 4.

The base 1 includes a base body 11 and a first connecting module 21 connected to a top end of the base body 11 for outputting electrical energy. The lamp head unit 3 includes a bottom seat 31, a lamp body 32 disposed on the bottom seat 31, and a lamp shell 33 covering the lamp body 32 and connected removably to the bottom seat 31.

The lamp body 32 includes a heat dissipater 321 connected to the bottom seat 31, a light-emitting member 323, and a circuit board 322 connected to the heat dissipater 321 and permitting the light-emitting member 323 to be mounted thereon. The bottom seat 31 includes a bottom end 312 connected to the top end of the base body 11, and a second connecting module 22 disposed at the bottom end 312 and connectable removably to the first connecting module 21. The electrical energy outputted by the first connecting module 21 is transmitted to the light-emitting member 323 of the lamp body 32 via the first and second connecting modules 21, 22. The bottom seat 31 has a coupling portion 311 at a top end thereof. The lamp shell 33 has a coupling portion 331 at a bottom end thereof, which is threaded to the coupling portion 311 of the bottom seat 31. As such, the lamp shell 33 is connected removably to the bottom seat 31.

The lamp shell 33 has a maximum width W1 at a position adjacent to the bottom end thereof, which is equal approximately to the maximum width W2. Alternately, the maximum width W1 of the lamp shell 33 may be smaller than the maximum width W2 of the bottom seat 31. The supporting unit 4 includes a supporting body 41 having top and bottom ends 413, 414, a third connecting module 21' disposed at the top end 413, and a fourth connecting module 22' disposed at the bottom end 414 and electrically connected to the third connecting module 21 via the supporting body 41.

With particular reference to FIGS. 1 and 2, when the lamp head unit 3 is connected to the base 1 in the first manner, the second connecting module 22 of the bottom seat 31 is connected to the first connecting module 21 of the base 1, so that electrical energy outputted by the first connecting module 21 of the base 1 is transmitted to the lamp head unit 3 via the second connecting module 22 of the bottom seat 31, so that the light-emitting member 323 is energized for illumination. The lampshade 5 is disposed on the base 1, and surrounds the lamp head unit 3, so as to enable light emitted from the light-emitting member 323 and transmitted through the lampshade 5 to become more gentle, such that the gentle light is distributed in a region having an outline corresponding to the shape of the lampshade 5, thereby providing an ornamental effect.

With particular reference to FIGS. 3 and 4, when the lamp head unit 3 is connected to the base 1 in the second manner, the third connecting module 21' is connected to the second connecting module 22 of the lamp head unit 3, and the fourth connecting module 22' is connected to the first connecting module 21 of the base 1, so that the supporting unit 4 is connected removably to the base 1 and the lamp head unit 3. As such, the base 1 is electrically connected to the lamp head unit 3, so as to allow electrical energy outputted by the first connecting module 21 of the base 1 to be transmitted to the light-emitting member 323 of the lamp head unit 3 via the supporting unit 4 for illumination. The lampshade 5 is disposed to surround the lamp head unit 3, and includes a shade body 51 and a head-connecting member 52 disposed on the shade body 51 and connected removably to the lamp shell 52 in a known manner, such that the lampshade 5 does not contact the base 1.

It should be noted that, since the lamp shell 33 has the maximum width W1 at a position adjacent to the bottom end thereof, when the lampshade 5 is replaced, it is not necessary to remove the lamp shell 33 in advance to prevent the head-connecting member 52 from being obstructed by the lamp shell 33. Hence, the head-connecting member 52 of the lampshade 5 is convenient to assemble to or separate from the lamp head unit 3, so that the lampshade 5 can be replaced easily and quickly. The first connecting module 21 has a first connecting portion 211 and a first conductive portion 212. The second connecting module 22 has a second connecting portion 221 and a second conductive portion 222. The third connecting module 21' has a third connecting portion 211' and a third conductive portion 212'. The fourth connecting module 22' has a fourth connecting portion 221' and a fourth conductive portion 222'. In this embodiment, each of the first and third connecting portions 211, 211' is configured as an externally threaded rod, and each of the second and fourth connecting portions 221, 221' is configured as a threaded hole engaging the corresponding externally threaded rod. Each of the first and third conductive portions 212, 212' is cylindrical, and extends from a central portion of an end surface of the corresponding threaded rod 211, 211'. Each of the second and fourth conductive portions 222, 222' has an end surface exposed in the corresponding threaded hole 221, 221' for electrical contact with a corresponding one of the first and third conductive portions 212, 212'. As such, the first connecting portion 211 of the base 1 is connected removably to the fourth connecting portion 221' of the supporting unit 4, and the second connecting portion 221 of the lamp head unit 3 is connected removably to the third connecting portion 211' of the supporting unit 4. In addition, the first conductive portion 212 of the base 1 is in electrical contact with the fourth conductive portion 222' of the supporting unit 4, and the second conductive portion 222 of the lamp head unit 3 is in electrical contact with the third conductive portion 212' of the supporting unit 4.

The base 1 further includes a portable power source 13 disposed removably in the base body 11, and a charging connector 12 disposed on the base body 11 and electrically connected to the portable power supply 13. The portable power supply 13 can be charged by connecting the charging connector 12 to another power supply (not shown). Since the portable power supply 13 serves as a power source of the lighting device, the lighting device can be used for illustration anywhere, and is not limited to use in a place having a specific type of power supply, so that the applicable range of the lighting device is increased. In this embodiment, the supporting body 41 of the supporting unit 4 has two rigid end portions 411, and a flexible rod section 412 connected between the rigid end portions 411 so that the supporting body 41 can be bent to change the shape and height of the lighting device.

Figure 5:
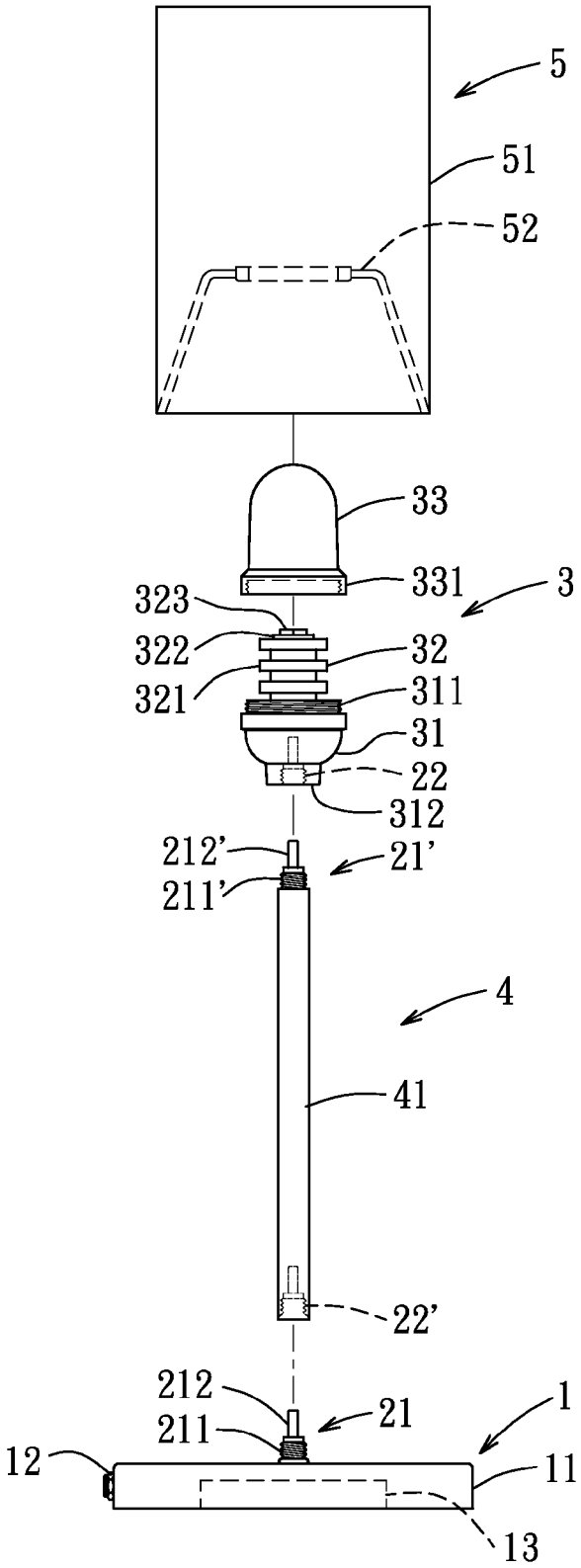
FIG. 5 is an exploded side view of the second preferred embodiment of a modular lighting device according to this invention.

FIG. 5 shows the second preferred embodiment of a lighting device according to this invention, which differs from the first preferred embodiment in that, in this embodiment, the flexible rod section 412 (see FIG. 4) is omitted from the supporting body 41, such that the whole supporting body 41 is configured as a vertical rigid rod, and extends upwardly from the base 1.

Figure 6:
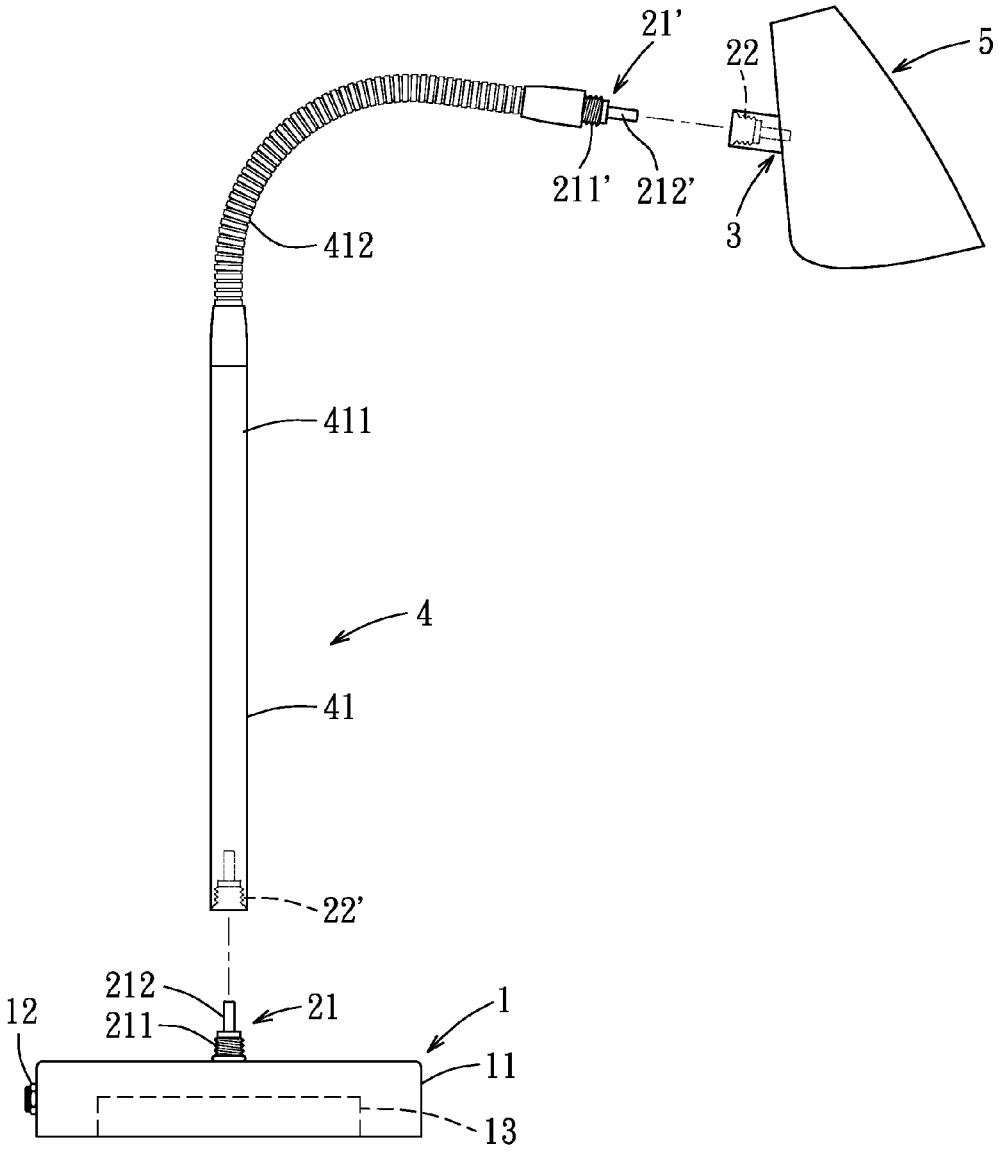
FIG. 6 is an exploded side view of the third preferred embodiment of a modular lighting device according to this invention.

FIG. 6 shows the third preferred embodiment of a lighting device according to this invention, which, unlike the first preferred embodiment, the supporting body 41 has a rigid rod section 411 extending upwardly from a top end of the base 1, and a flexible rod section 412 extending from a top end of the rigid rod portion 411 to connect with the lamp head unit 3. In this embodiment, a lampshade 5 commonly used for a desk lamp (not shown) is disposed on the lamp head unit 3.

Figure 7:
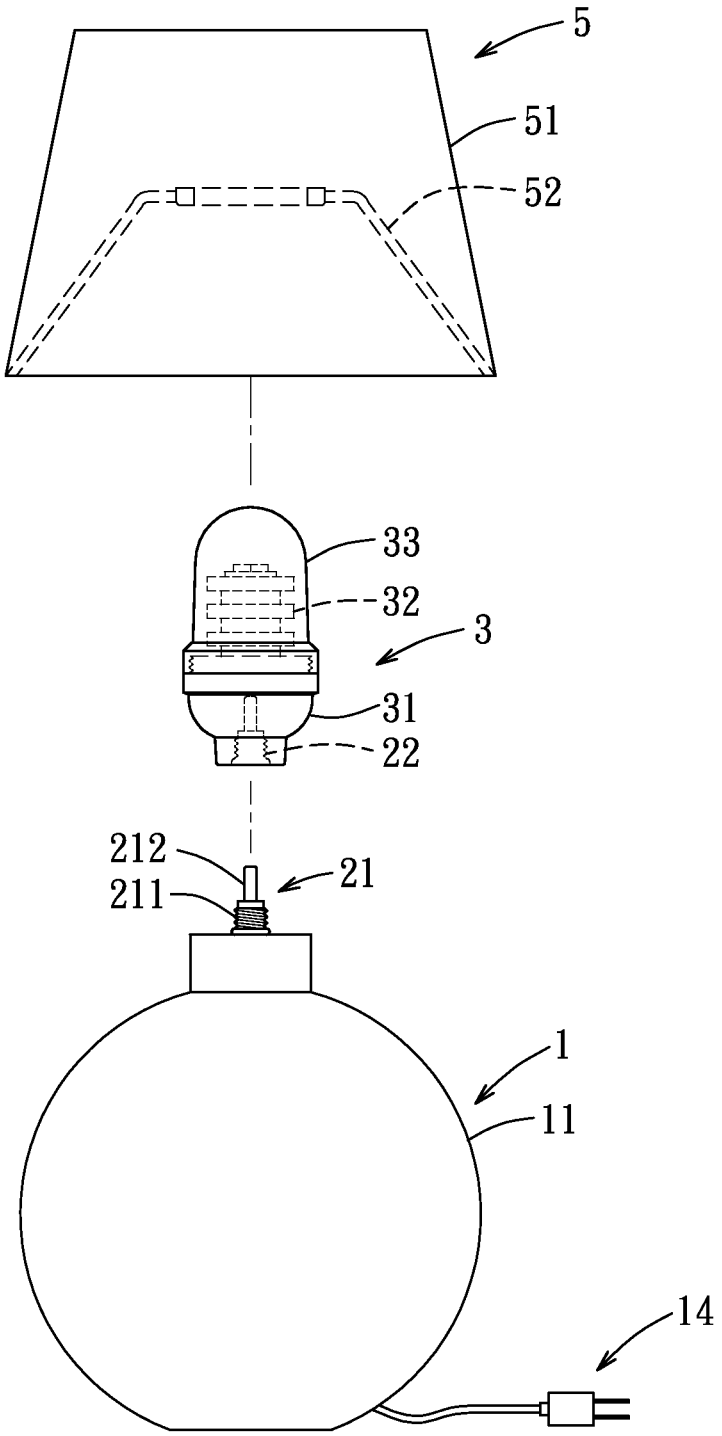
FIG. 7 is an exploded side view of the fourth preferred embodiment of a modular lighting device according to this invention.

FIG. 7 shows the fourth preferred embodiment of a lighting device according to this invention. In this embodiment, the base 1 is generally spherical such that, although the lamp head unit 3 is not supported by a supporting unit, it is disposed at a relatively high position. The spherical base 1 is provided with an electrical plug 14. If desired, the electrical plug 14 can be inserted into an electrical socket (not shown) for power transmission. The spherical shape of the base 1 is designed for ornamental purposes.

The shapes of the supporting unit 4, the base 1, and the lampshade 5 and the electricity supplying manner can be changed as long as the width of the lamp shell 33 of the lamp head unit 3 is selected to allow for convenient and easy replacement of the lampshade 5, and each of the base 1, the lamp head unit 3, and the supporting unit 4 can be removed conveniently and quickly.

With this invention thus explained, it is apparent that numerous modifications and variations can be made without departing from the scope and spirit of this invention. It is therefore intended that this invention be limited only as indicated by the appended claims.

I claim:

1. A modular lighting device comprising:

a base including a base body and a first connecting module that is disposed at a top end of said base body and that has a first connecting portion and a first conductive portion;

a lamp head unit disposed removably on said base and including a bottom seat, a lamp body that is disposed on said bottom seat, and a lamp shell that covers said lamp body and that is connected to said bottom seat, said bottom seat including a second connecting module that is disposed at a bottom end of said bottom seat and that has a second connecting portion connected removably to said first connecting portion, and a second conductive portion electrically connected to said first conductive portion, said lamp body including a light-emitting member electrically connected to said second conductive portion, said lamp shell having a maximum width that is disposed at a position adjacent to a bottom end of said lamp shell and that is smaller than or equal to that of said bottom seat; and a supporting unit that connects said lamp head unit removably to said base and that includes a supporting body having a top end and a bottom end, a third connecting module disposed on said top end of said supporting body, and a fourth connecting module disposed on said bottom end of said supporting body, said third connecting module having a third connecting portion connected removably to said second connecting portion of said second connecting module of said bottom seat of said lamp head unit, and a third conductive portion in electrical contact with said second conductive portion, said fourth connecting module having a fourth connecting portion connected removably to said first connecting portion of said first connecting module of said base, and a fourth conductive portion in electrical contact with said first conductive portion;

wherein said first and third connecting portions are configured as externally threaded rods, and said second and fourth connecting portions are configured as threaded holes engaging said externally threaded rods, respectively, and wherein each of said first and third conductive portions is cylindrical, and extends from a central portion of an end surface of a corresponding one of said externally threaded rods, and each of said second and fourth conductive portions has an end surface exposed in a corresponding one of said threaded holes and in electrical contact with a corresponding one of said first and third conductive portions.

2. The modular lighting device as claimed in claim 1, wherein said supporting body of said supporting unit has a flexible rod section.

3. The modular lighting device as claimed in claim 1, wherein said base further includes a portable power supply disposed removably within said base body, and a charging connector disposed on said base body and electrically connected to said portable power supply.

4. The modular lighting device as claimed in claim 1, further comprising a lampshade that includes a shade body surrounding said lamp head unit, and a head-connecting member disposed on said shade body and connected removably to said lamp head unit.

5. The modular lighting device as claimed in claim 1, wherein said lamp shell is connected removably to said bottom seat.

6. The modular lighting device as claimed in claim 1, wherein said lamp body of said lamp head unit further includes a heat dissipater connected to said bottom seat, and a circuit board connected to said heat dissipater and permitting said light-emitting member to be mounted thereon.

* * * * *